US010710253B2

(12) United States Patent
Gautier

(10) Patent No.: US 10,710,253 B2
(45) Date of Patent: Jul. 14, 2020

(54) TOOL EQUIPPED WITH A LOCKING DEVICE IN AT LEAST ONE POSITION OF A MOBILE PORTION OF THE TOOL

(71) Applicant: Geoffroy Gautier, Thiers (FR)

(72) Inventor: Geoffroy Gautier, Thiers (FR)

( * ) Notice: Subject to any disclaimer, the term of this patent is extended or adjusted under 35 U.S.C. 154(b) by 0 days.

(21) Appl. No.: 16/157,186

(22) Filed: Oct. 11, 2018

(65) Prior Publication Data

US 2019/0111576 A1 Apr. 18, 2019

(30) Foreign Application Priority Data

Oct. 17, 2017 (FR) ..... 17 59742

(51) Int. Cl.
*B26B 1/04* (2006.01)
*B26B 1/10* (2006.01)

(52) U.S. Cl.
CPC ..... *B26B 1/042* (2013.01); *B26B 1/10* (2013.01); *B26B 1/044* (2013.01)

(58) Field of Classification Search
CPC ..... B26B 1/042; B26B 1/10; B26B 1/044
See application file for complete search history.

(56) References Cited

U.S. PATENT DOCUMENTS 702,967 A * 6/1902 Kinney ..... B26B 1/02 30/155
1,179,111 A * 4/1916 Knowlton ..... B26B 1/02 30/155
5,515,610 A * 5/1996 Levin ..... B26B 1/04 30/155
6,591,505 B2 * 7/2003 Flavigny ..... B26B 1/042 30/161
6,675,484 B2 * 1/2004 McHenry ..... B26B 1/046 30/161
6,732,436 B2 * 5/2004 Moizis ..... B26B 1/044 30/155
7,337,486 B2 * 3/2008 Tsuda ..... B24D 15/084 7/120
7,536,788 B2 * 5/2009 VanHoy ..... B26B 1/02 30/154
8,443,521 B2 * 5/2013 Klecker ..... B26B 1/10 30/155
9,120,234 B2 * 9/2015 MacNair ..... B26B 1/044
10,071,489 B2 * 9/2018 MacNair ..... B26B 1/044
10,081,112 B2 * 9/2018 Langenwalter ..... B26B 1/042
2002/0029426 A1 * 3/2002 Seber ..... B25F 1/003 7/128
2002/0059730 A1 * 5/2002 Flavigny ..... B26B 1/042 30/161

(Continued)

*Primary Examiner* — Omar Flores Sanchez

(57) ABSTRACT

A tool having a first portion defining a housing for receiving a second portion mobile in rotation between a first inactive position and a second active position, said tool equipped with at least one locking device in at least one position of said second portion, said device having a portion pivoting about a shaft perpendicular to its largest dimension between at least one position where one end of the second portion is engaged in a notch formed in the end of the first portion, and another position where it is disengaged from said notch, said part being configured for a return to the inactive position by at least one return member, at least the elongated part, its pivot shaft and the at least one return member being cutout in the first portion.

6 Claims, 3 Drawing Sheets

(56) References Cited

U.S. PATENT DOCUMENTS

| | | | | |
|---|---|---|---|---|
| 2007/0245497 | A1* | 10/2007 | Tsuda | B24D 15/084 7/120 |
| 2010/0299933 | A1* | 12/2010 | Vellekamp | B26B 1/02 30/161 |
| 2011/0119926 | A1 | 5/2011 | Klecker | |
| 2013/0236236 | A1 | 9/2013 | Klecker | |
| 2016/0279810 | A1 | 9/2016 | Demko | |
| 2016/0354936 | A1 | 12/2016 | Busse | |
| 2017/0136634 | A1 | 5/2017 | Kao | |

* cited by examiner

TOOL EQUIPPED WITH A LOCKING DEVICE IN AT LEAST ONE POSITION OF A MOBILE PORTION OF THE TOOL

BACKGROUND OF THE INVENTION

The present invention relates to a tool equipped with a locking device in at least one position of a mobile portion of the tool.

The term "tool" designates here, in the broad sense, a tool provided with at least one mobile element forming an active portion of the tool. It may be a hand tool such as a folding knife, a saw, a shovel or a hand tool with a blade. This term also relates to a tool such as a handle, a measuring instrument, a handling tool or more generally a tool of which at least one active portion is configured as a mobile element between a so-called inactive position in which the element is, for example, inserted in a dedicated housing and/or in which the tool has a minimum volume and a so-called active position in which the element is usable and/or the tool has a maximum volume.

Subsequently, the invention will be described with reference to a hand tool of the folding knife type, it being understood that the invention may be applied to all types of tools as described above.

We know of hand tools, such as a closing knife, of which an active part, for example a blade or a corkscrew or a screwdriver-type accessory, is maintained, for safety reasons, locked in at least one position, namely at least the active position. Thus, it avoids accidental closure of the knife, so any non-voluntary folding of the blade in its housing. The locking devices are varied, some being adapted to also lock the mobile portion of the tool in the inactive position.

These various devices must be simple to manufacture, reliable and easy to use.

For example, US Patent A-2013/0236236 discloses a device locking the rails of a ladder in position. The device is integrated to a rail. It comprises a complex-shaped cutout of one end of the rail, so as to define a movable locking member by spring effect. The end of the member, according to the occupied position, engages with one of the notches provided on the end of the other rail, locking the latter in a given position, namely with folded or unfolded rails. We also know of folding knives whose blade is kept locked in at least the open position by a part, of the lever or push type.

This part comprises an end adapted to engage with a notch provided in the heel of the blade. The maneuver and/or the return of the part into position is ensured by spring effect. Such knives are, for example, described in US Patent A-2017/0136634; US Patent A-2016/0354936; US Patent A-2016/0279810. Such solutions involve the manufacture and assembly of a relatively large number of parts, with dimensional constraints involving an assembly carried out by an experienced person, so, at least in part, difficult to automate. These points therefore have an impact on the cost of manufacturing and the time required to produce such tools. US Patent A-2011/0119926 discloses a folding knife whose blade is held in position by a part formed by folding, said part being mobile by means of a deformable arm and also integral with the part. Such a solution does not allow a pivoting movement that is optimized, precise and minimizes the risk of deformation of the arm.

BRIEF SUMMARY OF THE INVENTION

The invention intends more particularly to address these drawbacks by proposing a tool equipped with a locking device in at least one position of a mobile element of the tool of optimized manufacture and assembly, with a minimum of parts and with manufacturing steps easy to automate.

For this purpose, the subject of the invention is a tool comprising a first portion defining a receiving housing of at least a second part, said second portion being mounted to rotate about a rotation shaft fixed on the first portion between a first so-called inactive position in which the second portion is housed in the first part, and a second so-called active position in which the second portion is out of its housing, said tool being equipped with at least one locking device in at least one position of said second part, said device comprising an elongated part, fixed on the first portion and pivotally mobile about a shaft perpendicular to its largest dimension, between at least one position where an end of the second portion is engaged in a notches arranged in the end of the first part, and another position where the end of the second portion is disengaged from the said notches, said part being configured for a return to the inactive position by at least one return member, the first portion being made at least by folding of a metal plate and in that at least the elongated part, its pivot shaft and the at least one return member constituting the locking device being made of material, by cutting, integrally formed with the first part, characterized in that the pivot shaft is defined by the center of a circle determined by a circular cutting line and in that the return member comprises at least one leaf spring type tab.

Thus, the tool made comprises a minimum of parts, typically a first and a second parts as well as a rotation shaft connecting two ends of the first and second parts, the other parts being integrally formed with the first part. Thanks to the invention, the shaping is performed by cutting and folding parts.

This not only allows a productivity gain with the possibility of automating the operations, at least partially, but also ensures an optimal adjustment of the component parts of the tool, the assembly operations being reduced to a minimum. The presence of a pivot shaft defined by a circular cut allows for a regular pivot movement, accurate and durable, even after many manipulations of the tool.

According to advantageous but non-mandatory aspects of the invention, such a tool may comprise one or more of the following characteristics:

- The end of the second portion is provided with at least one relief provided with a face adapted to be engaged with a notch formed in the end of the part of the first portion when the second portion is in active configuration.
- The end of the second portion comprises at least one other relief adapted to be engaged with a notch formed in the end of the part of the first portion when the second portion is in an inactive configuration.
- The tool comprises two return members formed by two leaf spring type tabs arranged angularly.
- The first portion is formed by longitudinal folding and bending along an axis of symmetry of a metal plate.
- The elongated part of the first portion is provided with a bearing zone adapted to allow pivoting of said part around its pivot shaft.
- The support zone is provided with a pullback adapted to provide a guided support for said part.

BRIEF DESCRIPTION OF THE SEVERAL VIEWS OF THE DRAWINGS

The invention will be better understood and other advantages thereof will appear more clearly on reading the following description of several embodiments of the invention, given by way of non-limiting example and with reference to the following drawings in which.

DETAILED DESCRIPTION OF THE INVENTION

Figure 1:
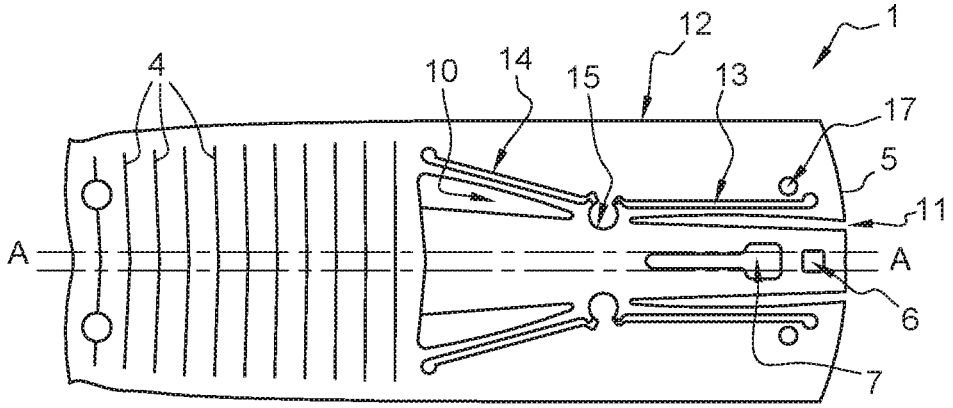
FIG. 1 is a view from above of the first portion, before folding and shaping by bending, of a tool according to an embodiment of the invention.
Figure 3:
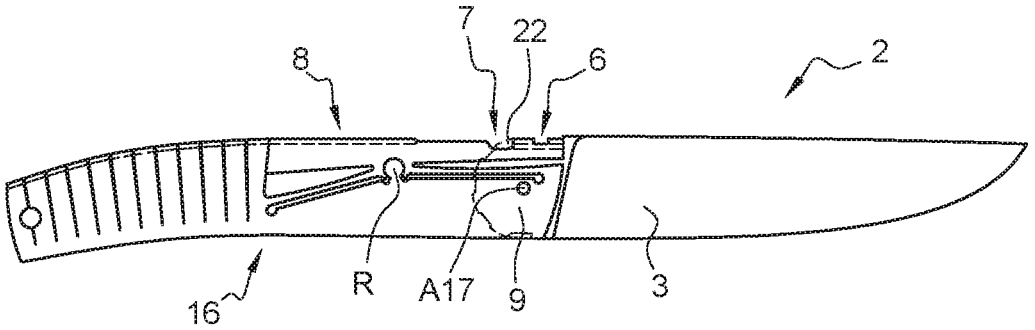
FIG. 3 is a side view, on a smaller scale, of the first folded and shaped portion, as shown in FIG. 2, in position on a tool with the mobile portion of the tool in active configuration.
Figure 4:
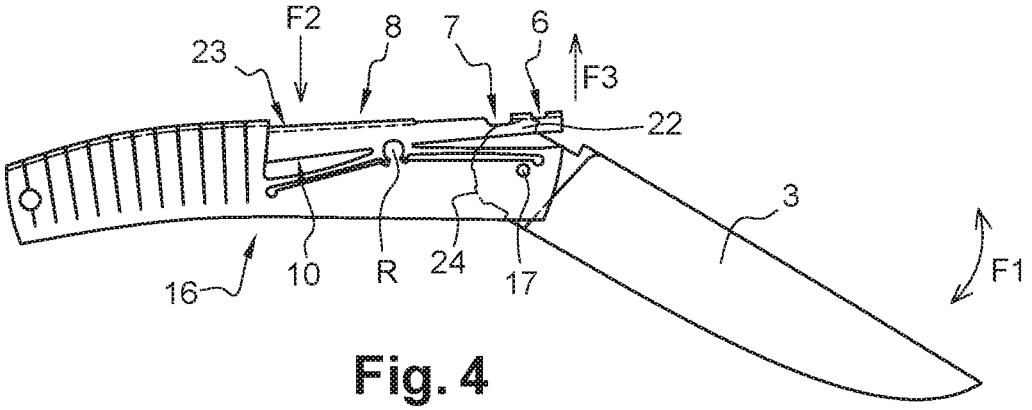
FIGS. 4 and 5 are side views similar to FIG. 3, and on a larger scale for FIG. 5, the mobile portion of the tool being respectively in the intermediate position between the active and inactive configurations in FIG. 4 and in the inactive configuration in FIG. 5.
Figure 5:
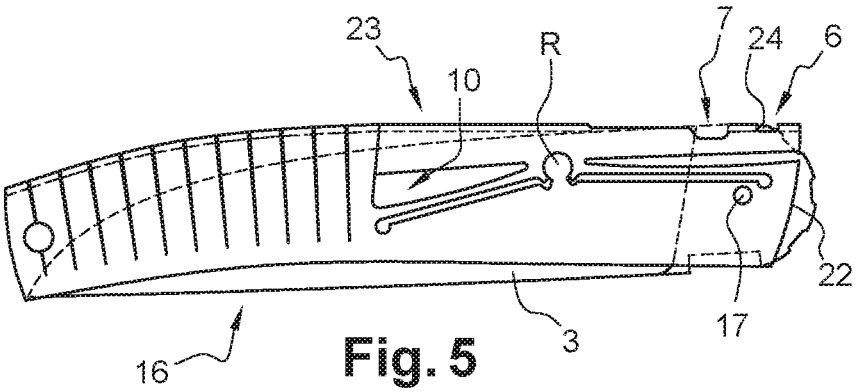

FIG. 1 illustrates a first portion 1 of a tool 2 according to an embodiment of the invention, before folding and, here, before it is mounted on the tool 2. The tool 2, in the embodiment illustrated in FIGS. 3 to 5 is a folding knife provided with a single blade 3 in order to facilitate the reading of the invention. The blade 3 forms the second active portion of the tool 2.

It is readily conceivable that in other embodiments, the knife, or more generally the tool, comprises more than one blade or, more generally, more than a second active portion. Similarly, the tool can be different from a knife. By way of non-limiting examples, mention may be made of a folding saw, a folding shovel, pliers with foldable handles, handles with adjustable length, tripods, folding step ladders, folding ladders or other tools known per se and having a folding portion.

Here, the first portion 1 is made of stainless steel. Alternatively, it is made of another metal or metal alloy. According to other embodiments, this first portion is made of another material, for example a polymer-based composite material provided that this material has physicochemical and mechanical characteristics similar to those of a metal or a metal alloy. Similarly, this first portion 1 can be painted, heat-lacquered, coated, galvanized or, more generally, covered with a protective and/or decorative coating. Here, the portion 1 is of raw appearance, the metal being simply polished.

The first portion 1 is generally rectangular in shape. Here, the first portion also has the function, once folded, of forming a handle to the tool 2. In other words, the first portion 1 also forms the handle of the folding knife 2.

When looking at FIG. 1, a series of parallel notches 4, oriented perpendicularly to a longitudinal axis AA of the first portion 1, are formed in the left portion thereof. These notches 4 define a grip zone of the tool. 2. They also participate in the folding of the first portion 1 and the setting in a given form of the latter, as will be detailed later.

Beyond the notches 4, on the right side of the first portion 1 when looking at FIG. 1, cutouts of complex geometric shapes define the elements of the locking device, according to one embodiment of the invention. These cutouts are made symmetrically with respect to an axis of symmetry coinciding with the longitudinal axis AA of the first portion 1.

In central position on the axis of symmetry AA, and in the vicinity of one of the small sides 5 of the first portion 1, a square cutout 6 is present. Another cutout 7, generally in the form of a square connected to a rectangular portion, is formed between the first cutout 6 and the notches 4. These two cutouts 6 and 7 form, after folding of the first portion 1, receiving housings formed on a long side 8 of the first portion 1 which is folded, for reliefs of complementary shapes and located on the end or heel 9 of the second active and mobile portion, or blade 3 of the tool 2, as will be detailed in FIGS. 3 to 5.

The long side 8 thus defines an elongated portion which is formed in the first portion and is mobile, as will be detailed later.

On either side of these two axially aligned cutouts 6 and 7, other cutouts of complex shapes are formed. These other cutouts are identical and symmetrical with respect to the axis AA.

We are now describing a set of cutouts located on the same side of the axis of symmetry, it being understood that an identical set of cutouts is present on the other side. In order to facilitate reading, only one set of cutouts is referenced in FIG. 1, it being understood that the identical and symmetrical cutouts bear the same references.

A cutout 10, in acute triangle, is arranged closest to the notches 4 and oriented, according to the height of the triangle, parallel to the axis of symmetry AA. Another cutout 11, substantially in the shape of a narrow and elongated V, is formed in the first portion 1. This cutout 11 is oriented parallel to the axis of symmetry AA and opens through its base on the small side 5 of the first portion 1, in the vicinity of the square cutout 6.

Between these two cutouts 10 and 11 and the long side 12 of the portion 1, two elongated cutouts 13 and 14, of a width much smaller than their length, are made on either side of a circular cutting line 15. The cutout 13 is oriented parallel to the axis of symmetry AA. The cutout 14 is angularly disposed with respect to the axis of symmetry AA. The cutting line 15 is positioned between the cutouts 13 and 14 and provide continuity between them.

Figure 2:
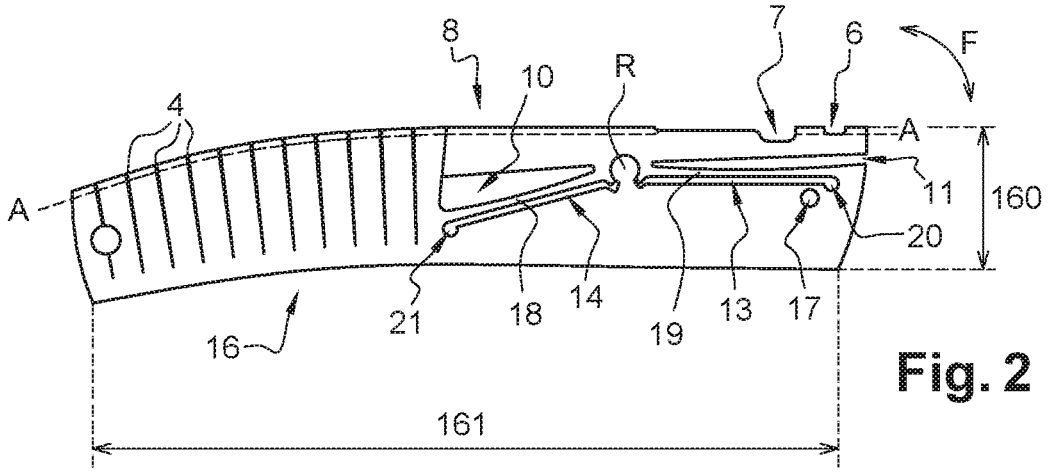
FIG. 2 is a side view, at the same scale, of the first portion illustrated in FIG. 1 after folding and shaping.

As is apparent from FIG. 2, once the first portion is folded and bent along its longitudinal axis AA, the notches 4 define a gripping zone or handle 16 notched and slightly curved. The notches 4, by their orientation and their distribution, facilitate the handling of the tool.

The cutouts 6 and 7, after folding and symmetrical longitudinal bending of the first portion 1, are located on the back, so on the large side 8 of the handle 16 of the tool 2 defined by the first folded portion 1, in the vicinity of the end of the handle 16 defined by the small folded side 5, which is intended to receive the active portion 3 of the tool 2. To mount the active portion 3, so the blade here, on the handle 16, an orifice 17 allows to insert a rotation shaft A17.

The cutouts 10, 11, 13 and 14 of complex shapes delimit, for the cutouts 10 and 11, recess areas located in portions of a rotation shaft R delimited by the circular section line 15. The rotation shaft R is defined by the center of the circle determined by the section line 15. In this way, a physical rotation shaft, obtained by cutting, is defined. The pivoting of the movable portion 8 constituting the locking device in at least one position of the second portion 3 is performed solely by a rotation about the rotation shaft R.

The cutouts 10, 11, 13 and 14 of complex shapes delimit, for the cutouts 10 and 11, recess areas located on either side of a rotation shaft R delimited by the circular cutting line 15. The rotation shaft R is defined by the center of the circle determined by the cutting line 15. In this way, a physical rotation shaft obtained by cutting is defined. The pivoting of the mobile part 8 constituting the locking device in at least one position of the second portion 3 is performed solely by a rotation about the rotation shaft R.

The recess zones 10, 11 are positioned on one half of the width 160 of the handle 16, it being understood that the recess zones 10, 11 occupy substantially a half-length 161 of the handle 16.

The elongated cutouts 13, 14, each having a circular end 20, 21, are located under the recess areas 10, 11. They define, with an edge of the recess areas 10, 11, two elongated tabs 18, 19 which form return members in leaf spring type position. Thus, once the first portion 1 is folded, a handle 16 is provided with a gripping zone, with the notches 4, and a mobile zone, with recesses 10, 11 in a limited pivoting movement and oriented perpendicularly to the longitudinal axis AA of the handle 16, according to the double arrow F.

FIG. 3 illustrates the handle 16 mounted with a blade 3 to form a folding knife 2. The blade 3 is equipped, on its rounded heel 9, with several reliefs of shape and dimensions complementary to those of the notches 6, 7. FIG. 3 shows the knife 2 in active configuration, so with the blade 3 out of the handle 16, which corresponds to a configuration of the so-called open blade. The latter is held and blocked in such a configuration by a relief 22 of its heel 9 in engagement with the notch 7. For this purpose, the relief 22 is, generally, in the shape of a circular arc terminated by a straight edge. The locking position of the relief 22 in the notch 7 is carried out by shape cooperation between an edge of the notch 7 and the straight edge of the relief 22. Thus, the blade 3 of the knife 2 is maintained in active configuration, without the risk of being accidentally closed, which optimizes the use and safety of this tool.

FIG. 4 illustrates the passage from the active configuration, wherein the blade 3 is deployed and aligned with the handle 16, to the inactive configuration, wherein the blade 3 is folded in the handle 16, the cutting edge of the blade 3 being then inaccessible. To perform this pivoting movement, illustrated by the double arrow F1, of the blade 3 around the shaft A17, the user must unlock the blade 3.

For this it is necessary to release the relief 22 of the heel 9 of the blade 3 of the notch 6 of the handle 16. During this step, the user exerts pressure on a zone 23 of the back 8 of the handle 16 located closest to the notches 4, behind the rotation shaft R and above the recess 10 of larger area. This pressure, pointing downwards in FIG. 4 along the arrow F2, causes the rotation of the back 8 of the handle 16, in particular its free end provided with the notches 6 and 7, upwards in a direction illustrated by F3 and oriented in the opposite direction of the direction F2 of the pressure. When looking at FIG. 4, the notch 6, which is no longer in contact with the rectilinear edge of the relief 22 of the heel 9 of the blade 3, is disengaged upwards. The rotational movement of the blade 3 according to double arrow F1 is facilitated by the arcuate shape of the relief 22.

The movement of the blade 3 continues until reaching the inactive configuration, shown in FIG. 5. In this case, at least the cutting edge of the blade 3 is entirely housed in the handle 16, therefore in a receiving housing defined by the space delimited by the flanks of the first portion 1 folded. The holding and locking in position of the blade 3 in this configuration are achieved in a manner similar to the active configuration. In other words, a straight edge of another relief 24, formed on the heel 9 of the blade 3 and similar to the relief 22, is engaged with an edge of the notch 6 of the handle 16. In this case, the portion of the handle 16, which was raised by the pressure exerted on the zone 23 by the user and which was held in the up position during the rotation of the blade 3 by the reliefs of the heel in contact with the solid zone of the handle 16 located between the notches 6 and 7, returns to the initial position as shown in FIG. 2. In other words, the tabs 18 and 19 of the handle 16 return in position, by spring effect, the mobile portion of the handle in the initial position, this as long as the user stops exerting pressure on the portion 23 of the handle 16. The blade 3 is safely held in the handle 16, without accidental risk of switching to the active configuration.

When the substantially straight face of the relief 24 is oriented towards the rotation shaft R, it is generally perpendicular to the axis AA, only a pressure of the user on the zone 23 of the back 8 of the handle, to disengage the relief 24 out of the notch 5, 6, allows to open the knife 2 and position the blade 3 in active configuration. In a variant, if the face is inclined angularly with respect to the axis AA, the release of the relief 24 out of the notch 6 is simply slowed.

Figure 6:
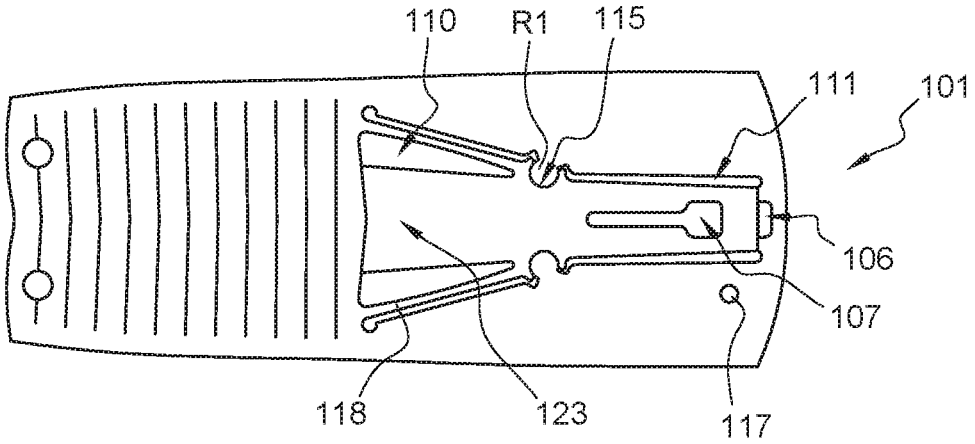
FIG. 6 is a view from above of the first portion, similar to FIG. 1, according to another embodiment of the invention.

FIG. 6 is a top view similar to FIG. 1 and illustrates another embodiment of the invention. Here, similar members, or members having the same functions as in the embodiment of FIG. 1, have the same references increased by one hundred. The part 101 corresponds to the first portion of a tool, before longitudinal folding and making the handle of the tool. Here, we find a notch 107 similar to the notch 7. In contrast, a notch 106 is located, unlike the notch 6, on a non-mobile portion of the part 101, near the free end of the part and attached to the mobile portion of the part. We find cutouts 110,115 and 111 similar to the cutouts 10, 15 and 11.

Here, the part 101 is devoid of cutouts similar to the cutouts 13. Therefore, if the pivoting around a pivot R1, defined by the circular cutting line 115, of a zone 123 induced by a pressure exerted by a user is similar to what is described for FIGS. 1 to 5, the return to position of the mobile portion is different. Here, there are no tabs equivalent to tabs 19. Only tabs 118 are present.

In other words, the return to position is obtained with a single leaf spring type member in FIG. 6, instead of two members of this type for the embodiment illustrated in FIGS. 1 to 5. Such an embodiment is simpler to implement since it limits the number of cutouts on the part 101. Nevertheless, it is necessary to compensate the absence of a second return member by an optimal flexibility of the constituent material of the part 101.

Figure 7:
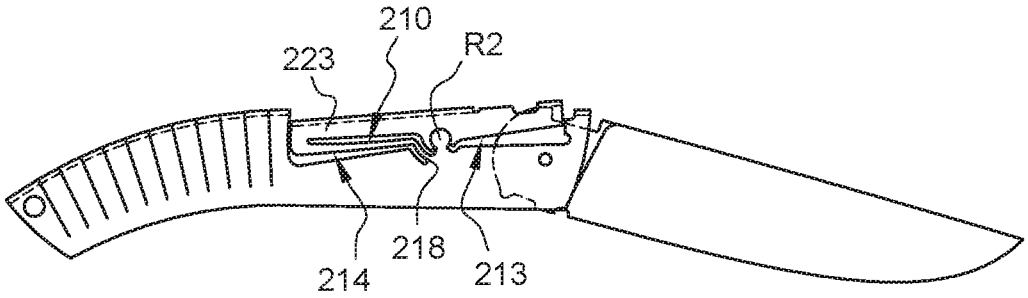
FIG. 7 is a view similar to FIG. 4 according to another embodiment of the invention.

FIG. 7 illustrates another embodiment of the invention. Here, similar members, or members having the same functions as in the embodiment of FIG. 1, have the same references increased by two hundred. As before, the movement of the mobile portion 223 of the locking device is performed around a rotation shaft R2 defined by a circular cutout. Here, the tab 218 is integrally formed from an area located closest to the shaft R2. Thus, a larger space is freed for the cutouts 213, 214 and the recess 210, which allows to obtain a greater stroke, with less pressure, for the portion 223 while enjoying an optimal return effort.

In any case, whatever the embodiment, the rotation shaft R, R1 or R2 is defined by a circular cutout.

In another embodiment, not shown, the movement of the mobile portion of the part is carried out in a guided manner, with a pullback located on the support zone of the back of the handle. In this case, the pressure exerted by the user is applied in a defined region, which makes it possible to optimize the movement. In other words, it limits the efforts of the user. Similarly, the one or more return member(s) may be of different shape from that illustrated. For example, they may be in the shape of an arc or a broken ring.

Alternatively, a tool may be equipped with several locking devices in at least one position of several mobile portions of the tool.

I claim:

1. A tool (2) comprising a first portion (1; 101) defining a receiving housing (16) of at least a second portion (3), said second portion (3) rotatably mounted (F1) about a rotation shaft (A17) fixed on the first portion (1; 101) between an inactive position in which the second portion (3) is housed in the first portion (1, 16; 101) and an active position in which the second portion (3) is out of its housing (16), said tool (2) equipped with at least one locking device in at least one position of said second portion (3), said device comprising an elongated part (8), fixed on the first portion (1; 101) and mobile (F) by pivoting about a shaft (R; R1; R2) perpendicular to a largest dimension (161) between at least one position where an end (19, 22) of the second portion (3) is engaged in a notch (7; 107) provided in an end of the first portion (1; 101) and another position where the end (19, 24) of the second portion (3) is disengaged from said notch (7; 107), the elongated part (8) configured for a return to the inactive position by at least one return member (18, 19; 118; 218), the first portion (1; 101) made at least by folding of a metal plate and in that at least the elongated part (8), its pivot shaft (R; R1; R2) and the at least one return member (18, 19; 118; 218) constituting the locking device integrally formed, by cutting, with the first portion (1; 101), wherein the pivot shaft (R; R1; R2) is defined by the center of a circle determined by a circular cutting line (15; 115), the return member comprising at least one leaf spring type tab (18, 19; 118; 218).

2. The tool according to claim 1, wherein the end (19) of the second portion (3) is provided with at least one relief (22) having a face adapted to be engaged with a notch (7; 107) formed in an end of the elongated part (8) of the first portion (1; 101) when the second portion (3) is in the active position.

3. The tool according to claim 2, wherein the end (19) of the second portion (3) comprises at least one other relief (24) adapted to be engaged with a notch (6; 106) formed in the end of the elongated part (8) of the first portion (1; 101) when the second portion is in the inactive position.

4. The tool according to claim 1, further comprising two return members formed by two tabs (18, 19; 118) of the leaf spring type arranged angularly.

5. The tool according to claim 1, wherein the first portion (1; 101) is formed by longitudinal folding and bending along an axis (AA) of symmetry of a metal plate.

6. The tool according to claim 1, wherein the elongated part (8) of the first portion (1; 101) is provided with a support zone (23; 123; 223) adapted to allow pivoting (F3) of the elongated part (8) around the pivot shaft (R; R1; R2).

* * * * *